United States Patent [19]

Pahl et al.

[11] Patent Number: 4,846,638

[45] Date of Patent: Jul. 11, 1989

[54] ROTARY FLUID MACHINE WITH PIVOTED VANES

[75] Inventors: Gerrit Pahl, Munich, Fed. Rep. of Germany; Henry A. Sherwood, Chapel Hill, N.C.

[73] Assignee: Balcomp Associates, New York, N.Y.

[21] Appl. No.: 148,012

[22] Filed: Jan. 25, 1988

[51] Int. Cl.[4] ..... F01C 1/44; F01C 5/04

[52] U.S. Cl. ..... 418/39; 418/108; 418/156; 418/260; 418/268; 418/5

[58] Field of Search ..... 418/39, 108, 156, 253, 418/254, 260, 261, 265, 268; 73/260

[56] References Cited

U.S. PATENT DOCUMENTS

| | | | |
|---|---|---|---|
| 156,814 | 11/1874 | Peck | 418/268 |
| 862,162 | 8/1907 | Honig . | |
| 945,746 | 1/1910 | Bratschie | 418/108 |
| 1,011,509 | 12/1911 | Smith . | |
| 1,700,038 | 1/1929 | Feuerheerd | 73/260 |
| 2,816,702 | 12/1957 | Woodcock | 418/108 |
| 3,012,511 | 12/1961 | Adams | 418/39 |
| 3,295,505 | 1/1967 | Jordan . | |

FOREIGN PATENT DOCUMENTS

| | | |
|---|---|---|
| 61328 | 9/1943 | Denmark . |

*Primary Examiner*—John J. Vrablik

*Attorney, Agent, or Firm*—Scully, Scott, Murphy & Presser

[57] ABSTRACT

A rotary fluid machine comprising a housing, a drive disk, a drive shaft, inner and outer cylindrical assemblies, and a plurality of vanes. The drive disk is supported within the housing for rotation about a first axis, and the drive shaft is connected to the drive disk to rotate that disk about the first axis. The inner and outer cylindrical assemblies extend within the housing, and the housing, the drive disk, and the inner and outer cylindrical assemblies form a working chamber that extends around, eccentric to, that first axis. The vanes are connected to the drive disc and are located in the working chamber to compress or to drive a fluid therein.

13 Claims, 3 Drawing Sheets

ROTARY FLUID MACHINE WITH PIVOTED VANES

BACKGROUND OF THE INVENTION

This invention generally relates to fluid machines, and more specifically to rotary fluid machines.

Rotary fluid machines are often used as compressors or pumps. Generally, these machines comprise a housing, fluid handling means such as a plurality of pistons or vanes, and central driving means to move the fluid handling means around the interior of the housing to drive a fluid from an inlet of the housing to an outlet thereof. Such machines are shown, for example, in U.S. Pat. Nos. 862,162; 1,011,509; and 3,295,505 and in Danish Pat. No. 61,328. While rotary machines operate very effectively in a wide range of circumstances, it is nonetheless believed that they may be improved upon in several respects. For example, the rotary machines disclosed in the above-identified references include rotating vanes or pistons that are mechanically directly linked or connected to a central drive assembly. This connection places limitations on the function and operation of those vanes and pistons.

SUMMARY OF THE INVENTION

This invention is a rotary fluid machine comprising a housing, a drive disk, drive means, inner and outer cylindrical assemblies, and a plurality of vanes. The drive disk is supported within the housing for rotation about a first axis, and the drive means is connected to the drive disk to rotate that disk about that first axis. The inner and outer cylindrical assemblies both axially extend within the housing and are spaced from each other. The housing, the drive disk, and the inner and outer cylindrical assemblies form a working chamber that extends around, eccentric to, the above-mentioned first axis. The vanes are connected to the drive disc and are located in the working chamber to compress or to drive a fluid therein. In operation, the drive disc rotates the vanes around the working chamber and the vanes frictionally engage the inner cylindrical assembly, and extend outward therefrom, across the working chamber, to positions closely adjacent the outer cylindrical assembly.

The vanes of this rotary machine are not mechanically directly linked or connected to the inner cylindrical assembly, and the inside and outside edges of the vanes are moveable relative to both the inside and outside cylindrical assemblies. Freeing the inside edges of the vanes for movement relative to the inner cylindrical assembly results in a number of advantages. For example, the vanes are secured within the compressor for pivotal movement about axes that are between the inner and outer cylindrical assemblies. The vanes pivot between extended positions, in which the vanes are spaced apart a relatively large distance, and collapsed positions, in which the vanes are closely adjacent.

The ratio of the space between the vanes when those vanes are in the extended positions to the space between the vanes when those vanes are in the collapsed positions is relatively large, resulting in a very efficient operation. At the same time, an outside member of the inner cylindrical assembly rotates with the vanes, resulting in negligible friction therebetween. Moreover, the vanes are designed so that, as inside edges of the vanes wear away, the vanes pivot outward, actually reducing the clearance between the vanes and the outside cylindrical assembly. The vanes are, thus, designed and positioned to automatically self compensate for frictional wear on the vanes.

Further benefits and advantages of the invention will become apparent from a consideration of the following detailed description given with reference to the accompanying drawings, which specify and show preferred embodiments of the invention.

A BRIEF DESCRIPTION OF THE DRAWINGS

DETAILED DESCRIPTION OF THE PREFERRED EMBODIMENTS

Figure 1:
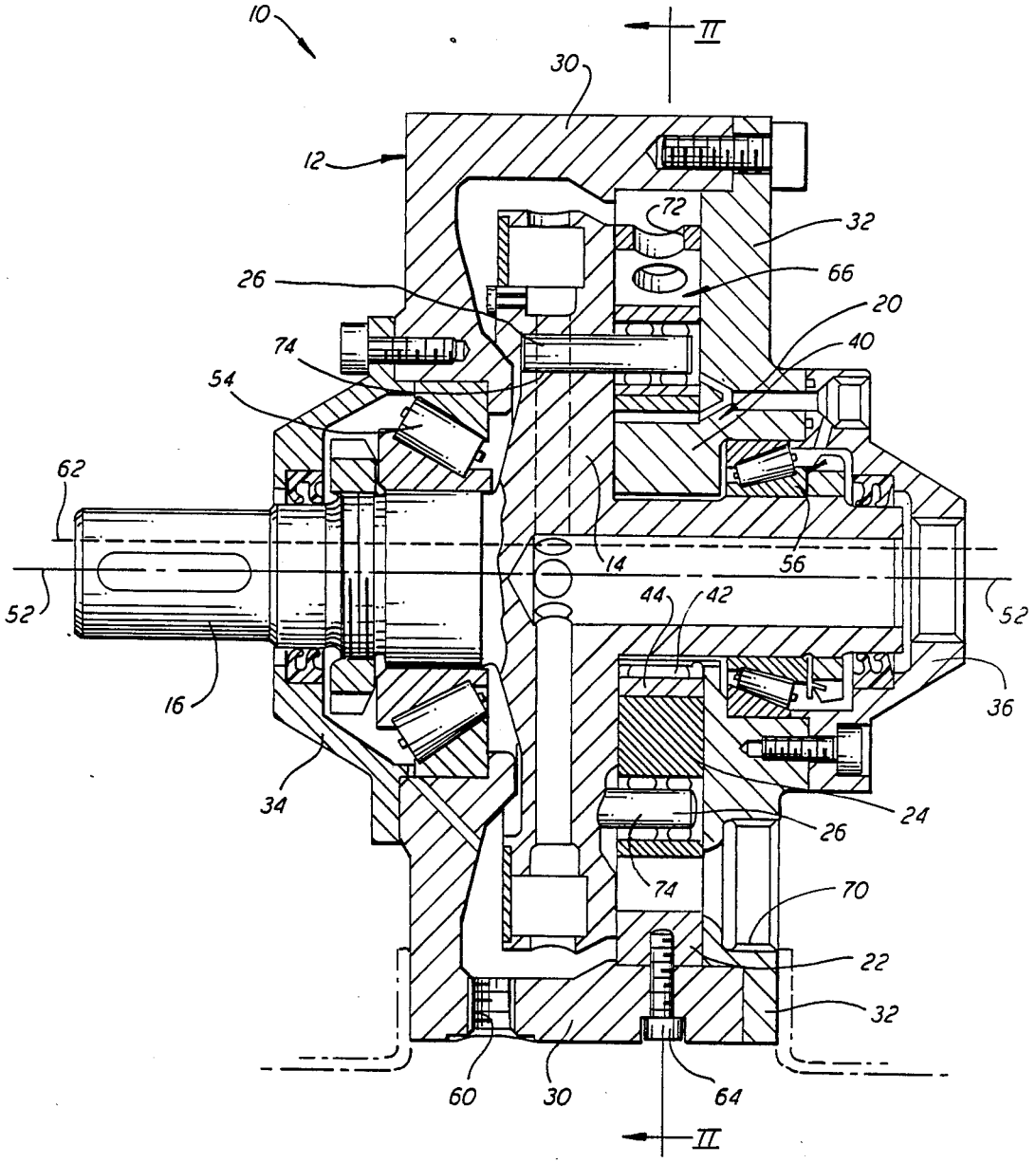
FIG. 1 is an axial cross-sectional view through a rotary fluid machine constructed in accordance with the present invention.
Figure 2:
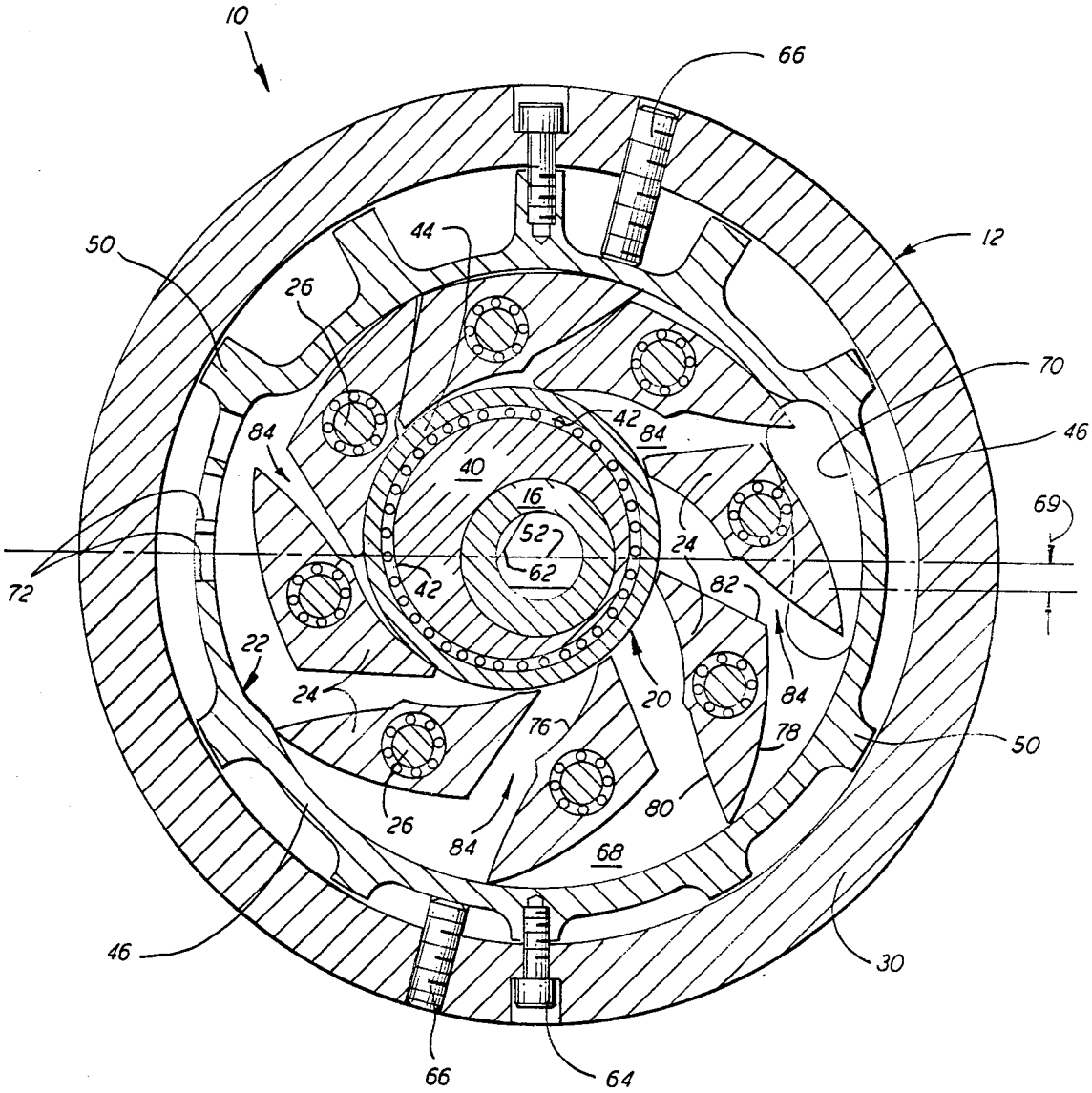
FIG. 2 is a diametric cross-sectional view through the rotary machine shown in FIG. 1, taken along line II—II thereof.

FIGS. 1 and 2 illustrate single stage rotary fluid machine 10 comprising, generally, housing 12, drive disk 14, drive shaft 16, inner cylindrical assembly 20, outer cylindrical assembly 22, a plurality of vanes 24, and a plurality of vane shafts 26. More specifically, housing 12 includes body 30, body top 32, left end cap 34, and right end cap 36; inner cylindrical assembly 20 includes inside tubular member 40, bearing 42, and bushing 44; and outer cylindrical assembly 22 includes body 46 and radial fingers 50.

With particular reference to FIG. 1, the various members of housing 12 are secured together in any suitable manner, for instance by a plurality of bolts, to form a generally enclosed space. Drive disk 14 is supported within housing 12 for rotation about a first axis 52, and drive shaft 16 is connected to drive disk to rotate that disk about the first axis. To elaborate, drive shaft 16 axially extends within housing 12 and is directly supported by a pair of spaced bearings 54 and 56, which in turn are directly supported by left and right ends of the machine housing, for rotation about the first axis 52. Drive shaft 16 also extends outside housing 12 for connection to any suitable motive source.

Drive disk 14 is connected to drive shaft 16 for rotation therewith about axis 52, and the drive disk radially extends outward from the drive shaft. As shown in FIG. 1, drive disk 14 is integral with drive shaft 16, although the drive disk and the drive shaft could be separable elements that are connected together, for instance, by one or more bolts. A supply of lubricant (not shown) may be located in housing 12 to lubricate bearings 54 and 56 and other parts of machine 10. Conventional lubrication passages may be formed through or in drive disk 14 and drive shaft 16 to conduct lubricant to various parts and areas of machine 10. Opening 60 is provided in housing 12 to connect rotary machine 10 to an oil cooler.

Inner cylindrical assembly 20 axially extends within housing 12, around and eccentric to first axis 52. More specifically, inside member 40 of assembly 20 has a tubular shape with an off-center bore and is mounted on drive shaft 16 in a close sliding fit therewith. Cylindrical bearing 42 is mounted on tubular member 40, concentric and in a close sliding fit therewith, and bushing 44 is mounted on bearing 42, concentric and in a close sliding fit therewith. Outside bushing 44 is supported for rotation about second axis 62 that is parallel to and spaced from first axis 52. Inside tubular member 40 is supported within housing 12 so that the member 40 remains stationary, relative to the machine housing, as drive shaft 16 rotates within housing 12. With the embodiment of the invention illustrated in the drawings, tubular member 40 of assembly 20 is integral with body top 32 of housing 12. Of course, tubular member 40 of assembly 20 may be separable from body top 32, although, if it is, it is preferred to connect that tubular member to the compressor housing to prevent member 40 from rotating with drive shaft 16.

Outer cylindrical assembly 22 axially extends within housing 12, between drive disk 14 and body top 32, and is spaced from and extends around inner cylindrical assembly 20. More specifically, body 46 of outer cylindrical assembly 22, although having a somewhat irregular shape, generally cylindrically call around axis 52 of drive shaft 16 and of drive disk 14. Radial fingers 50 of assembly 20 extend outward from body 46, toward compressor housing 12, and the outer cylindrical assembly 22 is secured in place by means of a plurality of bolts 64 that radially extend through the compressor housing and are threaded into radial fingers 50 A plurality of spacing pins 66 also extend through compressor housing 12, into abutting engagement with body 46 of outer cylindrical assembly 22 to maintain that assembly in a desired position within the compressor housing.

Drive disk 14, inner and outer cylindrical assemblies 20 and 22, and compressor housing 12, specifically body top 32 thereof, form a substantially enclosed generally annular working chamber or space 68. Chamber 68 extends around, eccentric to, axis 52 of drive shaft 16. The radial width of working chamber 68 varies due to, first, the eccentric positioning of inner cylindrical assembly 20 relative to outer cylindrical assembly 22, and second, the irregular shape of body 46 of the outer cylindrical assembly.

Inlet 70 is provided in compressor housing 12, specifically body top 32 thereof, for conducting fluid therethrough, into working chamber 68; and a plurality of outlets 72 are formed in the side wall of body 46 of outer cylindrical assembly 42 for conducting fluid from working chamber 68. The fluid discharged through outlets 72 passes into the space between compressor housing 12 and outer cylindrical assembly 22 and is discharged from that space by means of an outlet (not shown) in the compressor housing.

Vanes 24 are located within working chamber 66 to compress or to drive fluid therethrough; and vane shafts 26 connect the vanes to drive disc 14, first, for rotation therewith about axis 52 of the drive disc, and second, for pivotal movement about vane axes that are between inner and outer cylindrical assemblies 20 and 22. In particular, vanes 24 are mounted on vane shafts 26. Shafts 26, in turn, are secured in a tight pressure fit within openings 74 in drive disc 14 and are equally spaced apart on a circle that is eccentric with respect to inner cylindrical assembly 20.

During operation of machine 10, the inside edges of vanes 24 engage inner cylindrical assembly 20, specifically bushing 44 thereof, and the vanes extend outward therefrom, across working chamber 68, to positions closely adjacent outer cylindrical assembly 22. At the same time, because of the eccentric spacing of shafts 26 about inner cylindrical assembly 20, contact between vanes 24 and the inner cylindrical assembly forces the vanes to pivot about vane shafts 26 between extended positions—the positions of the vanes when shafts 26 are the maximum distance from inner cylindrical assembly 20—and collapsed positions—the positions of the vanes when the vane shafts are their minimum distance from the inner cylindrical assembly.

Shafts 26 may be located anywhere between the inside and outside edges of vanes 24, although preferably the axis of each vane shaft extends near, but slightly spaced from, the center of mass of the vane that is mounted on the shaft so that the mass of each vane is nearly, but not exactly, balanced around the shaft on which that vane is mounted. It is preferred to position the axis of each shaft 26 slightly spaced from the center of mass of the vane mounted on the shaft so that, in operation, the mass of the vane forces the vane to follow the contour of the radially inside surface of body 46 of outer cylindrical assembly 22. Also, preferably, each vane 24 is mounted on a shaft 26 so that the pressure forces on the surfaces of the vane radially inward of the shaft are equal to the pressure forces on the surfaces of the vane radially outward of the shaft, producing a symmetrical pressure load on each vane. A bearing is disposed between each vane shaft 26 and the vane 24 mounted thereon to facilitate the pivotal movement between that vane and vane shaft.

It should be observed that other suitable means may be used to connect vanes 24 to drive disk 14. For instance, vanes 24 may be pivotally connected to drive disk 14 by means of axial protrusions extending from the drive disk. It should be noted also that body 46 of outer cylindrical assembly 22 is shaped so that the inside surface of that body is in close proximity to vanes 24 during at least a major portion of the movement of the vanes in working chamber 68

With particular reference to FIG. 2, vanes 24 are substantially identical; and each vane includes inside and outside arcuate surfaces 76 and 78, oblique leading surface 80 and oblique trailing surface 82. Inside and outside surfaces 76 and 78 form arcs of different, generally concentric circles. The radius of curvature of inside surfaces 76 is substantially identical of the radius of curvature of the outside surface of bushing 44 of inner cylindrical assembly 20, and the radius of curvature of outside surfaces 78 is substantially identical to the radius of curvature of the inside surface of body 46 of outer cylindrical assembly 22 in the area of that body that is closest to the inner cylindrical assembly. The leading and trailing surfaces 80 and 82 of each vane 24 extend between the inside and outside surfaces 76 and 78 thereof. These leading and trailing surfaces 80 and 82 of vanes 24 are shaped so that adjacent leading and trailing surfaces of neighboring vanes are closely adjacent and complementary to each other when the vanes are in the collapsed position, in the narrowest portion of working chamber 68.

Vanes 24 divide working chamber 68 into a multitude of cells or compartments 84. The size of an individual cell 84 increases as the vanes that bound that cell move from the narrowest portion of working chamber 68 to the widest portion thereof, and the size of each cell 84 decreases as the vanes that border that cell move from the latter portion to the former portion.

Inlet 70 and outlets 72 are located so that the cells 84 of working chamber 68 are larger as they move past inlet 70 than when they move past outlet 72. The movement of vanes 24, caused by drive disk 14 and inner cylindrical assembly 20, that causes the size of cells 84 to decrease as the cells move from inlet 70 to outlet 72, compresses or drives the fluid within those cells.

The annular location of inlet 70 can be changed by rotating housing body top 32. This, in turn, can be done simply by removing the bolts connecting body top 32 to housing body 30 and then rotating the body top about drive shaft 16. Altering the location of inlet 70 changes the size of the cell 84 directly adjacent the inlet and which directly receives the fluid passing into the working chamber 68 from the inlet. When machine 10 operates as a fluid compressor, changing the location to inlet 10 changes the extent to which that fluid in cells 84 is compressed, changing the compression ratio of machine 10.

In operation, fluid is conducted into working chamber 68 via inlet 70, and vanes 24 are driven around that chamber by drive disk 14 and drive shaft 16. As individual cells 84 move past inlet 70, the cell fills with fluid, and as the cell moves from inlet 70 to outlet 72, the size of that cell decreases, compressing or driving the fluid in the cell. The fluid is discharged from chamber 68 through outlet openings 72.

Body 46 of outside cylindrical assembly 22 bowes radially outward in the area of outlet 72. This bowed area smoothes the transition of the fluid flow from cell 84, where the fluid flow is in a generally circumferential direction, through outlets 72, where the fluid flow is in a generally radial direction.

As cells 84 move from inlet 70 to outlet 72, the pressure of the fluid in the cells gradually increases, and the pressure difference between neighboring cells is relatively small. This, in combination with the facts that, first, inner edges of vanes 24 engage inner cylindrical assembly 20, and second, outer edges of those vanes are closely adjacent outer cylindrical assembly 22, eliminates the need for any separate fluid seals between vanes 24 and the inner and outer cylindrical assemblies 20 and 22.

During the operation of fluid machine 10, the frictional engagement between bushing 44 and vanes 24 causes the bushing to rotate with the vanes. Because of this, there is minimal frictional wear on the inside edges of vanes 24. Over time, though, those inside edges will wear to some extent. As this occurs, vanes 24 pivot outward about shafts 26 toward body 46 of outer cylindrical assembly 22. This actually has a beneficial result by reducing the clearance between vanes 24 and outside cylindrical assembly 22, further reducing any fluid leakage between cells 84. Preferably, vanes 24 do not actually come into contact with body 46, as that would cause undesirable wear on the outside edges of those vanes. In order to prevent this, body 46 is slightly expandable in the radial direction, and that body may be expanded or pulled radially outward, as needed, by means of bolts 64, to maintain a slight clearance between body 46 and vanes 24.

When the operation of machine 10 is stopped, vanes 24 come to rest in positions spaced from inner and outer cylindrical assemblies 20 and 22. As a result, the fluid pressure in working chamber 68 equalizes very rapidly. When rotary machine 10 is then restarted, there is no fluid pressure load on vanes 24. Further, when machine 10 stops, vanes 24 come to rest in balanced positions without any torque or bending moments on the vanes due to engagement between those vanes and adjacent elements of rotary fluid machine 10.

Figure 3:
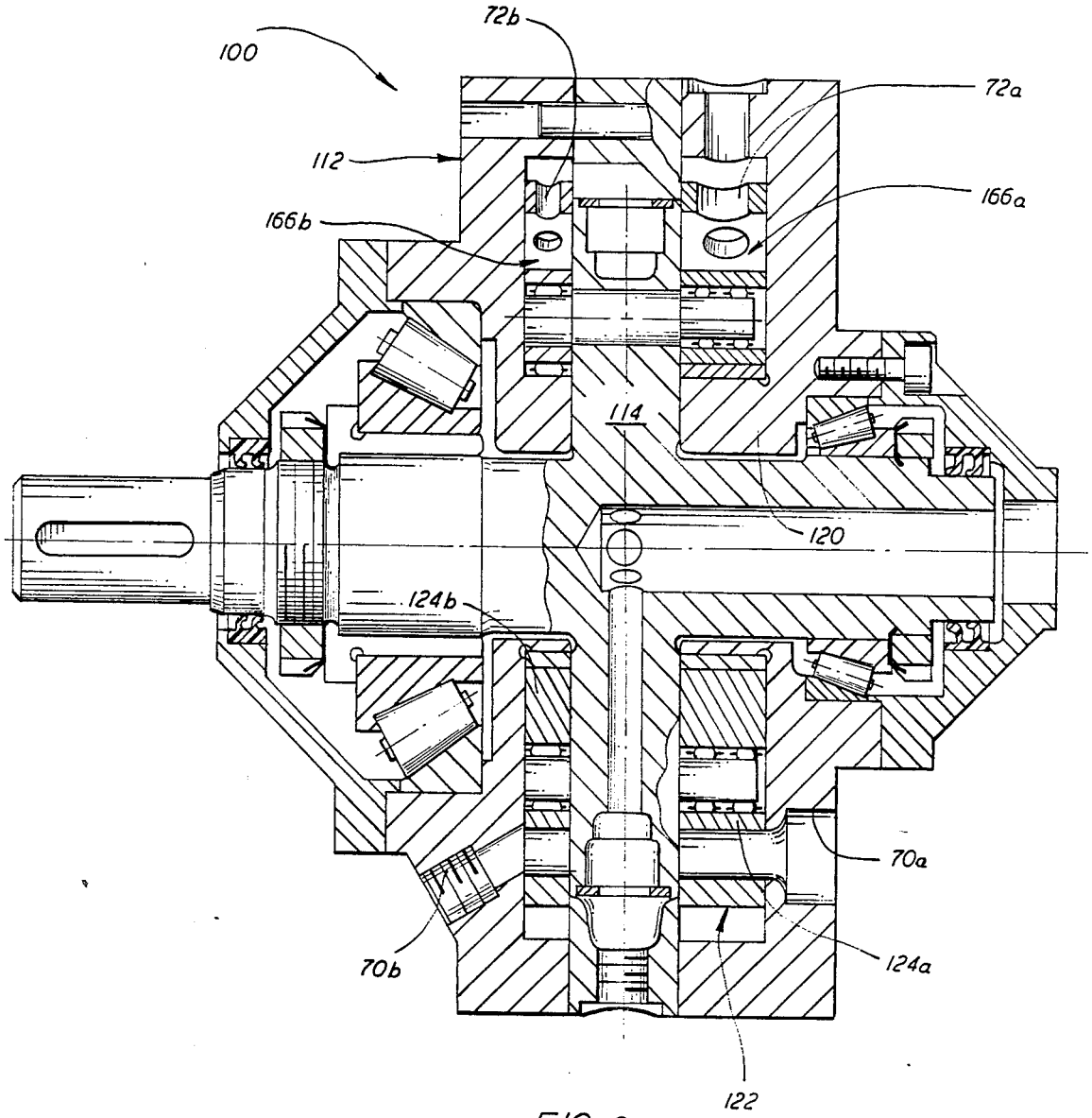
FIG. 3 is an axial cross-sectional view through a two stage rotary fluid machine also employing teachings of this invention.

As will be appreciated by those skilled in the art, the principles of the present invention may also be employed in multi-stage rotary machines, whether those stages are connected in series or in parallel. For example, FIG. 3 shows rotary machine 100 having first and second stages connected together in series. Machine 100 is very similar to machine 10 discussed above, and parts of the former machine that correspond to parts of the latter machine are given the same reference numerals as the latter parts, prefaced by the digit "1." The principle difference between rotary machines 100 and 10 is that, with the former machine, housing 112, drive disk 114, inner cylindrical assembly 120, and outer cylindrical assembly 122 form two annular working chambers **166*a* and 166*b*. A series of vanes 124*a* and 124*b* are mounted in each of these chambers 166*a* and 166*b* ——in a manner identical to the way in which vanes 24 of machine 10 are mounted in working chamber 66. Individual inlets 70*a* and 70*b* and outlets 72*a* and 72*b* are provided for each stage of machine 100, and a tube or pipe (not shown) is connected to the outlet of first stage 166*a* and to the inlet of second stage 166*b*** to connect those two stages in series.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

We claim:

1. A rotary fluid machine comprising:

a housing;

a drive disk supported within the housing for rotation about a first axis;

drive shaft means axially extending within the housing and connected to the drive disk to rotate the drive disk about the first axis;

an inner cylindrical assembly axially extending within the housing, around and eccentric to the first axis;

an outer cylindrical assembly axially extending within the housing and spaced from and extending around the inner cylindrical assembly, the housing, the drive disk, and the inner and outer cylindrical assemblies forming a generally annular working chamber extending around and eccentric to the first axis;

means for conducting fluid into the working chamber;

means for discharging fluid from the working chamber;

a plurality of vanes located in the working chamber to frictionally engage the inner cylindrical assembly and extending outward therefrom, across the working chamber, to positions closely adjacent the outer cylindrical assembly; and a plurality of connecting means, each connecting means connecting a vane to the drive disk for rotary movement herewith about the first axis and for pivotal movement about a an axis intermediate the inner and outer cylindrical assemblies;

wherein (i) the radial width of the working chamber aries between minimum and maximum widths, (ii) the connecting means support the vanes for pivotal movement between extended and collapsed positions, (iii) the vanes are in the extended position as the vanes pass through the portion of the working chamber having the maximum radial width, (iv) the vanes are in the Collapsed position as the vanes pass through the portion of the working chamber having the minimum radial width, and (v) as each vane passes through the portion of the working chamber having the minimum radial width, the vane complementarily fits closely against an immediately adjacent vane.

2. A rotary fluid machine according to claim 1, wherein:

each vane includes inside and outside arcuate surfaces, a leading surface extending between the inside and outside surfaces, and a trailing surface extending between the inside and outside surfaces; and as each vane passes through the portion of the working chamber having the minimum radial width, the leading surface of the vane extends radially outside of and closely adjacent to the trailing surface of said immediately adjacent vane.

3. A rotary fluid machine according to claim 2, wherein the inner cylindrical assembly pivots each vane from the expanded position to the collapsed position as the vane passes into the portion of the working chamber having the minimum width.

4. A rotary fluid machine according to claim 2 wherein:

as each vane passes through the portion of the working chamber having the minimum radial width, (i) the inside surface of the vane is closely adjacent and substantially complementary to the inside cylindrical assembly, and (ii) the outside surface of the vane is closely adjacent and substantially complementary to the outside cylindrical assembly.

5. A rotary fluid machine comprising:

(a) a housing;

(b) a drive disk supported within the housing for rotation about a first axis;

(c) drive shaft means axially extending within the housing and connected to the drive disk to rotate the drive disk about the first axis;

(d) an inner cylindrical assembly axially extending within the housing, around and eccentric to the first axis, and including an inside tubular member mounted on the drive shaft means and supported for rotation relative thereto, and an outside bushing cylindrically extending around the inside tubular member and supported for rotation relative thereto about a second axis, parallel to and spaced from the first axis;

(e) an outer cylindrical assembly axially extending within the housing and spaced from and extending around the inner cylindrical assembly, the housing, the drive disk, and the inner and outer cylindrical assemblies forming a generally annular working chamber extending around and eccentric to the first axis;

(f) means for conducting fluid into the working chamber;

(g) means for discharging fluid from the working chamber;

(h) a plurality of vanes located in the working chamber to frictionally engage the inner cylindrical assembly and extend outward therefrom, across the working chamber, to positions closely adjacent the outer cylindrical assembly; and (i) a plurality of connecting means, each connecting means connecting a vane to the drive disk for rotary movement therewith about the first axis and for pivotal movement about a vane axis intermediate the inner and outer cylindrical assemblies.

6. A rotary fluid machine according to claim 5 wherein frictional engagement between the vanes and the bushing rotates the bushing as the drive disk rotates the vanes.

7. A rotary fluid machine according to claim 5 wherein:

(a) the radial width of the working chamber varies between minimum and maximum widths;

(b) the connecting means support the vanes for pivotal movement between extended and collapsed positions;

(c) the vanes are in the extended position as the vanes pass through the portion of the working chamber having the maximum radial width; and (d) the vanes are in the collapsed position as the vanes pass through the portion of the working chamber having the minimum radial width.

8. A rotary fluid machine according to claim 5 wherein outside edges of the vanes pivot outward toward the outer cylindrical assembly as inside edges of the vanes wear away.

9. A rotary fluid machine according to claim 5 wherein the connecting means support each vane for pivotal movement about the center of the mass of the vane.

10. A rotary fluid machine according to claim 5 wherein:

(a) the outer cylindrical assembly is radially expandable; and (b) the rotary fluid machine further includes means to expand the outer cylindrical assembly radially outward.

11. A rotary fluid machine according to claim 5 wherein:

(a) the vanes form a plurality of cells in the working chamber;

(b) the size of the cells vary around the working chamber;

(c) the housing includes a body and a body top;

(d) the means for conducting fluid into the working chamber includes an inlet in the body top; and (e) the housing further includes means releasably connecting the body top to the body to facilitate moving the body top and moving the location of the inlet to change the size of the cell immediately adjacent the inlet.

12. A rotary fluid machine comprising:

(a) a housing;

(b) a drive disk supported within the housing for rotation about a first axis;

(c) drive shaft means axially extending within the housing and connected to the drive disk to rotate the drive disk about the first axis;

(d) an inner cylindrical assembly axially extending within the housing and cylindrically extending around a second axis parallel to and spaced from the first axis;

(e) an outer cylindrical assembly axially extending within the housing and spaced from and extending around the inner cylindrical assembly, the housing, the drive disk, and the inner and outer cylindrical assemblies forming a generally annular working chamber having a radial width that varies between minimum and maximum widths;

(f) means for conducting fluid into the working chamber;

(g) means for discharging fluid from the working chamber;

(h) a plurality of vanes located in the working chamber and engaging the inner cylindrical assembly and extending outward therefrom, across the working chamber, to positions closely adjacent the outer cylindrical assembly; and (i) a plurality of vane shafts, each vane shaft connected to the drive disk and carrying a vane (1) for rotary movement with the drive disk about the first axis, and (2) for pivotal movement about a vane axis between extended and collapsed positions;

(j) the inner cylindrical assembly including (1) an inside tubular member mounted on the drive shaft means and supported for rotation relative thereto, and (2) an outside bushing cylindrically extending around the inside tubular member, engaging the vanes and supported for rotation relative thereto about said second axis; and (k) engagement between the vanes and the bushing (1) rotates the bushing as the drive disk rotates the vanes, and (2) pivots the vanes between the extended and collapsed positions;

(l) the vanes are in the extended position as they pass through the portion of the working chamber having the maximum radial width; and (m) the vanes are in the collapsed position as they pass through the portion of the working chamber having the minimum radial width.

13. A rotary fluid machine according to claim 12 wherein:

(a) the vanes include inside and outside arcuate surfaces;

(b) the inside surfaces of the vanes are closely adjacent and substantially complementary to the inner cylindrical assembly as the vanes pass through the portion of the working chamber having the minimum radial width; and (c) the outside surfaces of the vanes are closely adjacent and substantially complementary to the outer cylindrical assembly as the vanes pass through the portion of the working chamber having the minimum radial width.

* * * * *

UNITED STATES PATENT AND TRADEMARK OFFICE

CERTIFICATE OF CORRECTION

PATENT NO. : 4,846,638

DATED : July 11, 1989

INVENTOR(S) : Henry Sherwood

It is certified that error appears in the above-identified patent and that said Letters Patent is hereby corrected as shown below:

Title page:

In the Abstract, line 6: "about the first" should read as --about that first--

Column 3, line 9: "call" should read as --extends--

Column 4, line 35: "68" should read as --68.--

Column 5, line 11: "to" should read as --of--

Column 6, line 57: "herewith" should read as --therewith--

Column 6, line 58: "an" should read as --vane--

Column 6, line 61: "aries" should read as --varies--

Signed and Sealed this

Twenty-ninth Day of May, 1990

*Attest:*

HARRY F. MANBECK, JR.

*Attesting Officer*

*Commissioner of Patents and Trademarks*